United States Patent [19]

Corbley

[11] 4,013,919

[45] Mar. 22, 1977

[54] DISCHARGE LAMP HAVING FUSE-SWITCH GUARD AGAINST JACKET FAILURE

[75] Inventor: Eugene K. Corbley, Cleveland Heights, Ohio

[73] Assignee: General Electric Company, Schenectady, N.Y.

[22] Filed: Aug. 4, 1975

[21] Appl. No.: 601,858

[52] U.S. Cl. ..... 315/73; 315/49; 315/74; 315/85

[51] Int. Cl.[2] ..... H05B 41/231; H01J 7/44

[58] Field of Search ..... 315/46, 47, 49, 56, 315/73, 74, 75, 85; 328/7; 337/33, 34; 313/25, 184, 229, 312

[56] References Cited

UNITED STATES PATENTS

| | | | |
|---|---|---|---|
| 2,020,737 | 11/1935 | Pirani et al. | 315/49 |
| 2,899,583 | 8/1959 | Macksoud | 313/485 X |

FOREIGN PATENTS OR APPLICATIONS

| | | |
|---|---|---|
| 1,051,948 | 12/1966 | United Kingdom |
| 267,753 | 4/1970 | U.S.S.R. |

*Primary Examiner*—Eugene R. LaRoche
*Attorney, Agent, or Firm*—Ernest W. Legree; Lawrence R. Kempton; Frank L. Neuhauser

[57] ABSTRACT

The inner arc tube of some jacketed discharge lamps transmits ultraviolet radiation which is normally absorbed without harm by the glass outer envelope but may be released should the outer envelope be broken off. This is prevented by a fuse heater and shunting thermal switch connected in series with the arc tube and located within the outer envelope. Should the outer envelope be broken, air cools the switch so that it opens. Current flow through the heater now raises its temperature and causes it to oxidize, thereby opening the circuit and disabling the lamp.

5 Claims, 2 Drawing Figures

DISCHARGE LAMP HAVING FUSE-SWITCH GUARD AGAINST JACKET FAILURE

The invention relates to jacketed discharge lamps of the kind wherein the inner arc tube transmits ultraviolet radiation which is normally absorbed without harm by the glass outer jacket.

BACKGROUND OF THE INVENTION

Some common types of high intensity discharge lamps used for lighting comprise a quartz or fused silica arc tube enclosed within a glass outer jacket fitted with a screw base at one end. In high pressure mercury vapor lamps the arc tube contains a filling of mercury, whereas in high pressure metal halide lamps, the arc tube contains a filling of mercury and metal halides. In both kinds, the inner arc tube transmits ultraviolet radiation which is absorbed without harm by the glass outer envelope, or even absorbed gainfully by a phosphor coating on the outer envelope.

In most lamps the outer envelope remains intact to the end, and life is ended by other factors. However it does happen occasionally that the outer envelope or glass jacket is shattered and the arc tube remains intact so that the lamp may continue to operate. In this mode of operation, the ultraviolet radiation from the arc tube is not restrained and may create a safety hazard.

It has been proposed to provide a lead wire fuse of a metal which oxidizes rapidly upon contact with air. Such fuse located in the outer envelope burns up when air enters and disables the lamp. However, the continuous ohmic loss due to current flow through the lead wire fuse entails a substantial reduction in overall efficiency, particularly in lamps of lower wattage, and a better solution is desired.

SUMMARY OF THE INVENTION

The object of the invention is to provide a jacketed discharge lamp with means for disabling the arc tube and preventing the emission of harmful radiation should the outer envelope be shattered, and which does not reduce lamp efficiency during operation.

A jacketed discharge lamp embodying my invention includes within the outer envelope a lead serving as a fuse and as a heater and which is made of a metal that oxidizes rapidly upon contact with air when heated to a high temperature by flow of the lamp current through it. The heater is shunted by a thermal switch located in heat receiving relationship relative to it. The switch is closed initially by heat from the heater but is maintained closed in normal lamp operation by heat radiated and conducted from the arc tube. The volume within the outer jacket is normally evacuated or filled with an inactive gas such as nitrogen so that the lead wire will not oxidize during normal operation. Failure of the jacket while the lamp is on allows air to enter and cool the switch so that it opens. Lamp current is then drawn through the heater which rapidly oxidizes and opens the circuit. The lamp is thereby disabled and emission of harmful ultraviolet radiation is prevented.

DESCRIPTION OF PREFERRED EMBODIMENT

Figure 1:
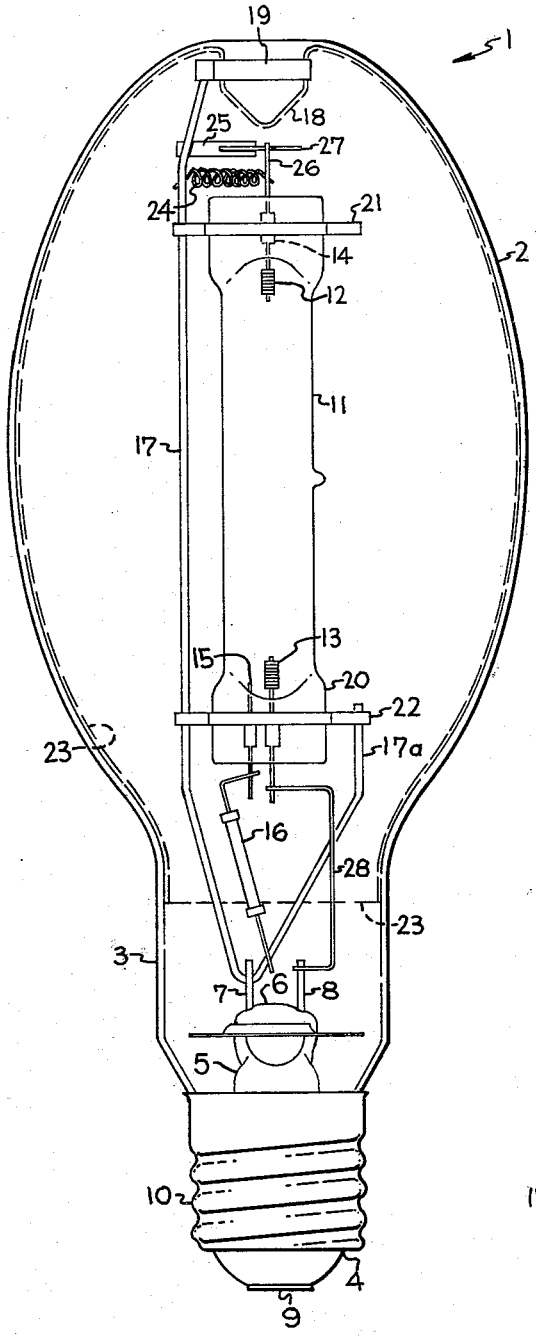
FIG. 1 shows a high pressure metal vapor lamp embodying the invention.

Referring to the drawing and more particularly to FIG. 1, there is shown a high pressure mercury vapor lamp 1 embodying the invention in preferred form. It comprises a glass outer envelope or jacket 2 of ellipsoidal shape having a neck 3 to the end of which is attached a screw type base 4. The neck 3 is closed by a reentrant stem 5 having a press portion 6 through which extend relatively stiff inlead wires 7, 8. The inlead wires are connected exteriorly to the contact surfaces of the base, namely the insulated center contact or eyelet 9 and the base shell 10.

Inner arc tube 11 is made of fused silica, commonly referred to as quartz, and encloses a charge of mercury and an inert starting gas, suitably argon at a pressure of about 20 torr. In a metal halide lamp, the filling would include additionally small quantities of one or more metallic halides, for instance sodium and scandium iodides. The arc tube is provided at opposite ends with a pair of main discharge supporting electrodes 12, 13 to which connections are made by ribbon type inleads 14 sealed through the flattened ends of the tube. A fine tungsten wire 15 sealed into the arc tube at its lower end serves as an auxiliary starting electrode and is connected through a current limiting resistor 16 to inlead 7 by way of side rod 17. The side rod is welded to inlead 7 at the base end and extends to anchoring dimple 18 at the dome end of the envelope which it engages by a looped clip 19. The arc tube is attached to the mount frame by clamping its flat ends 20 between strap clips 21, 22 which are welded to side rod 17, the lower clip being additionally welded to reverted portion 17*a* of the side rod.

The arc discharge through mercury vapor at a pressure exceeding one atmosphere generates both visible and ultraviolet radiation which is transmitted by the fused silica arc tube envelope. The glass outer envelope 2 may be clear in which case the ultraviolet radiation is merely absorbed without harm. In so-called deluxe mercury lamps, the outer envelope is coated internally with a phosphor layer 23 which converts some of the shorter wavelength radiation produced by the discharge into visible light including red whereby the color rendition from the lamp is greatly improved. The space within outer envelope 2 may be either evacuated or filled with an inactive gas such as nitrogen.

It is possible for the jacket to be broken away and the arc tube to remain intact. For instance when a lamp as illustrated is operated base-up, it is conceivable that the jacket upon being struck by a ball or projectile would shatter and fall off without breaking the arc tube or the connections thereto. The lamp may continue to operate in this fashion for a considerable time during which the ultraviolet radiation from the arc tube is freely radiated and may create a safety hazard.

Figure 2:
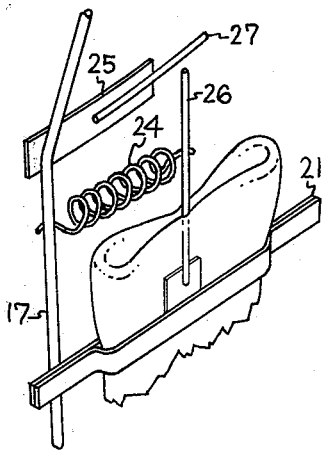
FIG. 2 is a pictorial detail of the fuse heater and thermal switch.

In accordance with my invention, the foregoing possibility is removed by providing an oxidizable lamp lead wire formed into a coil 24 and of wire diameter such that the lamp current heats it to a temperature where it oxidizes rapidly upon exposure to air. This coil serves as a fuse and also as a heater for a thermal switch comprising a bimetal strip 25 located in close proximity to it and extending alongside. The coil extends from side rod 17 to inlead 26 of main electrode 12 and the switch is connected to shunt the coil. The moving end of the bimetal has a tungsten wire 27 attached to it which contacts inlead 26 when the switch is heated. When the lamp is cold, the switch is open as illustrated in FIG. 2. The connection between lower main electrode 13 and stem inlead 8 is made by a relatively stiff formed nickel-plated iron wire 28.

Under normal circumstances, when power is first applied to the lamp, the bimetal switch is in the open position illustrated in FIG. 2. The lamp arc current flows through coil 24 and heats it to incandescence. Because the volume within the outer envelope is either exhausted or filled with a non-oxidizing gas, the coil wire will not oxidize even though it is incandescent. However if the outer jacket should have failed, air in contact with the incandescent coil will rapidly oxidize it and cause it to break, thereby disabling the lamp. If the outer envelope is intact, heat radiated and conducted from the incandescent coil will cause bimetal switch 25 to close, thereby short-circuiting the coil. The bimetal switch now replaces the coil in the lamp circuit, whereby the power consumed in the coil to maintain it in incandescence is saved. Such power may amount to 10 to 20 watts, and in a 175 watt lamp for instance, represents a drop in efficiency possibly exceeding 10% which is avoided by my invention. During normal lamp operation, the heat radiated and conducted from the arc tube is sufficient to maintain the switch closed. However if at any subsequent time the outer jacket should fail and allow air to come in contact with the switch, it will lose heat rapidly and reopen, thereby placing the coil back into circuit. The wire coil will then immediately heat up to incandescence, oxidize, and break. Once this happens, the bimetal switch can never close again and the lamp will remain permanently inoperative.

The coil configuration of the fuse heater allows a higher temperature to be reached for a given diameter of wire than does a straight wire for the same overall length. The oxidizing lead wire must be of a material capable of withstanding the temperatures present during outer envelope sealing and exhausting but must oxidize and burn through rapidly if exposed to air during lamp operation. By placing the fuse heater and thermal switch at the dome end of the lamp removed from the base, the possibility of oxidation due to the high temperature during sealing of the outer envelope is avoided and the operating temperature is minimized. Among suitable metals which may be used for the fuse heater are zirconium, niobium, alloys of niobium and zirconium, and also molybdenum and tungsten.

In the case of a 400 watt mercury lamp, a suitable fuse heater may consist of six turns of 0.015 inch zirconium wire used in conjunction with a bimetal switch of type E5 material, 0.010 inch thick, available from Texas Instruments, Inc. During normal operation, the switch closed and remained closed soon after the lamp was turned on, whereby waste of power in the heater during operation was avoided. When the outer jacket was removed, the switch opened and the coil oxidized and burnt through in less than 30 seconds.

My invention thus provides a safety feature by which the lamp is permanently disabled when the jacket is broken off and which consumes no energy and does not reduce lamp efficiency during normal operation.

What I claim as new and desire to secure by Letters Patent of the United States is:

1. A jacketed electric lamp comprising a vitreous outer envelope having inleads sealed therethrough;
   a vacuum or a nonoxidizing filling in said outer envelope;
   an inner envelope of material which transmits ultraviolet radiation within said outer envelope;
   said inner envelope having electrodes sealed into its ends and containing an ionizable medium comprising a metal which produces radiation including ultraviolet which is transmitted by the inner envelope and normally intercepted at the outer envelope;
   and means connecting the electrodes of the inner envelope to the inleads of the outer envelope, said means including a fuse-switch comprising a resistive heater connected in series circuit with the inner envelope and made of a metal that oxidizes rapidly upon contact with air at the temperature caused by normal lamp current flow through it, and a thermal switch shunting said heater and located in heat-receiving relationship from said heater and from said inner envelope, said switch being normally open when the lamp is off but closing upon heating by said heater, and thereafter being held closed by heat from said inner envelope when the lamp is operating normally but cooling and reopening upon air contact should the outer envelope be broken, whereupon said heater carries lamp current and oxidizes rapidly, culminating in burn through of said heater and permanent disablement of the lamp.

2. A lamp as in claim 1 wherein the heater is a coil of metal wire and the thermal switch is a bimetal extending alongside.

3. A lamp as in claim 1 wherein the heater is a coil of wire chosen from the metals zirconium, niobium and alloys thereof, and molybdenum and tungsten.

4. A lamp as in claim 1 wherein the outer envelope has a neck at one end through which the inleads are sealed, and the fuse-switch is located at the opposite end of said outer envelope and close to an end of said inner envelope.

5. A lamp as in claim 1 wherein said inner envelope is a fused silica arc tube having an ionizable filling which includes mercury.

* * * * *